US012137762B1

(12) United States Patent
McClain

(10) Patent No.: US 12,137,762 B1
(45) **Date of Patent: *Nov. 12, 2024**

(54) ELASTIC PONYTAIL EXTENSION

(71) Applicant: Monika McClain, Columbia, TN (US)

(72) Inventor: Monika McClain, Columbia, TN (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/231,753

(22) Filed: Aug. 8, 2023

Related U.S. Application Data

(63) Continuation of application No. 17/307,263, filed on May 4, 2021, now Pat. No. 11,771,157.

(51) Int. Cl.
*A41G 5/00* (2006.01)

(52) U.S. Cl.
CPC ..... *A41G 5/0053* (2013.01)

(58) Field of Classification Search
CPC ..... A41G 5/00; A41G 5/004; A41G 5/0046; A41G 5/0053; A41G 5/0086; A41G 5/0093; A41G 3/00; A41G 3/0041; A41G 3/005; A41G 3/0058; A41G 3/0008; A41G 3/0033; A41G 3/0016; A41G 3/0025; A41G 3/0066; A41G 3/0083; A41G 3/0075; A45D 7/00; A45D 2007/004
See application file for complete search history.

(56) References Cited

U.S. PATENT DOCUMENTS 11,771,157 B1 * 10/2023 McClain ..... A41G 5/0053 132/201

* cited by examiner

*Primary Examiner* — Cris L. Rodriguez
*Assistant Examiner* — Karim Asqiriba
(74) *Attorney, Agent, or Firm* — Shane Cortesi

(57) ABSTRACT

A hair extension for a ponytail is described. The hair extension may comprise an elastic band having a looped end and a free end. A plurality of hairs may be connected to the band by weaving or sewing the plurality of hairs into a track or weft that is then attached to the band. The elastic band may have a taut and a relaxed configuration. The track or weft may be attached to the band while the band is in the taut configuration such that when the band is relaxed, the track or weft is wavy. The looped end of the band may be formed by folding a tip of the band over and securing it to a portion of the band. The loop may have an opening through which a user's natural hair may be inserted.

17 Claims, 3 Drawing Sheets

ELASTIC PONYTAIL EXTENSION

BACKGROUND

Technical Field

The present invention relates to hair extensions, specifically hair extensions designed for use with ponytail hairstyles.

Background of the Invention

In the beauty industry, there is a desire to have long, voluminous hair, specifically when hair is put into a ponytail hairstyle. In some cases, persons may not have long hair because their hair type does not grow long before falling out, is very thin when grown out, or does not otherwise appear healthy when grown out. In other cases, persons may have a desire to change back and forth between long and short hairstyles. Current hair extensions may use hook and loop fasteners (VELCRO), adhesives, or pins, all of which may damage a user's hair or scalp. Thus, there is a continuing need to attach hair extensions to a user's natural hair to give the appearance of a long, voluminous ponytail without damaging the user's natural hair or scalp.

SUMMARY OF THE INVENTION

The present disclosure provides an elastic ponytail extension as described herein. The hair extension may comprise an elastic band, the elastic band comprising: a looped end comprising a loop, the loop comprising a loop outer end, a loop opening through which a human user's hair can extend, and a loop base located on a side of the loop opening opposite the loop outer end; a band free end opposite the looped end; a length extending from the looped end to the free end; a top; a bottom; a height extending from the top to the bottom and perpendicular to the length; a front side; a rear side; a thickness extending from the front side to the rear side and perpendicular to the length and height; a free end segment comprising the band free end and having a free end segment length extending parallel to the band length; a looped segment comprising the looped end and having a looped segment length extending parallel to the band length; and an intermediate segment located between the free end segment and the looped segment and having an intermediate segment length extending parallel to the band length.

The hair extension may further comprise a plurality of strands of hair extending downwardly from the band intermediate segment, each strand comprising a strand top end, a free strand bottom end located opposite the strand top end, and a strand length extending from the strand top end to the strand bottom end and substantially parallel to the band height. Optionally, the band length is greater than the band height and band thickness. Optionally, the intermediate segment length is greater than the free end segment length and the looped segment length. Each strand in the plurality of strands may have approximately the same length. The band height may be greater than the band thickness.

Preferably, the hair extension further comprises a track connecting the plurality of strands to the band intermediate segment. The track may comprise a first end, a second end, a length extending from the first end to the second end and parallel to the band length, a top, a bottom, a height extending from the top to the bottom and parallel the band height, a front side, a rear side, and a thickness extending from the front side to the rear side and parallel to the band thickness. The track length may be substantially equal to the band intermediate segment length. Further, the track may be secured to the band across the band intermediate segment.

Further, the band may have a taut configuration and a relaxed configuration. The band length, free end segment length, intermediate segment length, and loop segment length may be shorter in the relaxed configuration than in the taut configuration length. A user may move the band from the relaxed configuration to the taut configuration by pulling the band free end and band looped end further away from each other. The track may or may not be elastic but is preferably not elastic. Optionally, the track length is substantially equal to the intermediate segment length in the taut configuration. In some cases, the band intermediate segment and track may be substantially straight when the band is in the taut configuration, and/or the band intermediate segment and track may be wavy when the band is in the relaxed configuration.

Optionally, the plurality of strands are sewn or woven into the track. Optionally, each strand in the plurality of strands is comprised of artificial hair, natural hair, or a combination of artificial and natural hair.

Optionally, a tip of the band in the looped segment curves back towards the intermediate segment and secures to the band to form the loop. Optionally, the loop segment, intermediate segment, and free end segment of the band are made from on continuous piece of material. A tip of the band may be sewn to a portion of the band in the looped segment or in the intermediate segment.

In an exemplary embodiment, the band height is approximately one half of an inch; the strand length is between about 10 inches and about 18 inches; the band length is between about 18 inches and about 30 inches; the loop opening has a diameter of between about 1 inch and about 2 inches; the free end segment length is between about 3 inches and about 5 inches.

Further, the plurality of strands may be colored. Optionally, the hair strands and the band are the same color. Optionally, the plurality of strands are located in clusters that are spaced substantially evenly apart about the band intermediate segment length. Preferably, the hair extension comprises at least one hundred strands.

The present invention provides a method of use for the hair extension described in paragraphs 3-10. The method of attaching a hair extension of a user's hair may comprise the steps of providing the hair extension of paragraphs 3-10 and removably securing the hair extension to a user's hair. Preferably, the user's hair is a ponytail. The hair extension may be removably secured to a user's hair by inserting the user's hair through the loop opening, wrapping the intermediate segment and free end segment of the band around the user's hair to form a ponytail with the plurality of strands, securing the free end to prevent the band from unwrapping, and/or wrapping a portion of the plurality of strands around the base of the ponytail to cover the band.

In another embodiment, the hair extension may comprise a band, the band comprising: a looped end comprising a loop, the loop comprising a loop outer end, a loop opening through which a human user's hair can extend, and a loop base located on a side of the loop opening opposite the loop outer end, a band free end opposite the looped end, a length extending from the looped end to the free end, a top, a bottom, a height extending from the top to the bottom and perpendicular to the length, a front side, a rear side, a thickness extending from the front side to the rear side and perpendicular to the length and height, a free end segment located adjacent the band free end and having a free end segment length extending parallel to the band length, a looped segment adjacent the looped end and having a looped segment length extending parallel to the band length, and/or an intermediate segment adjacent the free end segment and the looped segment and having an intermediate segment length extending parallel to the band length.

The hair extension may further comprise a plurality of strands of hairs extending downwardly from the band intermediate segment, each strand having a strand top end, a free strand bottom end located opposite the strand top end, and/or a strand length extending from the strand top end to the strand bottom end and/or substantially parallel to the band height.

The hair extension may further comprise a track connecting the plurality of strands to the band intermediate segment, the track comprising a first end, a second end, a length extending from the first end to the second end and parallel to the band length, a top, a bottom, a height extending from the top to the bottom and parallel the band height, a front side, a rear side, and/or a thickness extending from the front side to the rear side and parallel to the band thickness.

In some cases, the track length is substantially equal to the band intermediate segment length. The track may be secured to the band across the band intermediate segment. The band length may be greater than the band height and band thickness. The intermediate segment length may be greater than the free end segment length and the looped segment length.

Optionally, a tip of the band in the looped segment curves back towards the intermediate segment and secures to the band to form the loop. Optionally, the loop segment, intermediate segment, and free end segment of the band are made from on continuous piece of material. Optionally, the tip of the band is secured to the same or the opposite side of the band that the track is connected to. Optionally, each strand in the plurality of strands is comprised of artificial hair, natural hair, or a combination of artificial and natural hair.

BRIEF DESCRIPTION OF THE DRAWINGS

in FIG. 1, the band and track of the hair extension are detached from each other, and the band is in the relaxed configuration.

in FIG. 2, the band and track of the hair extension are detached from each other, and the band is in the taut configuration.

in FIG. 3, the band and track of the hair extension are attached to each other using a sewing machine, and the band is in the taut configuration.

in FIG. 4, the band and track form a wavy or curved shape, and the band is in the relaxed configuration.

in FIG. 5, the hair extension is removed from a user's ponytail.

in FIG. 6, the user's ponytail extends through the loop opening of the hair extension loop.

in FIG. 7, the hair extension band is wrapped around a user's ponytail while the plurality of hairs hang downward from and cover the user's ponytail.

DETAILED DESCRIPTION

Figure 1:
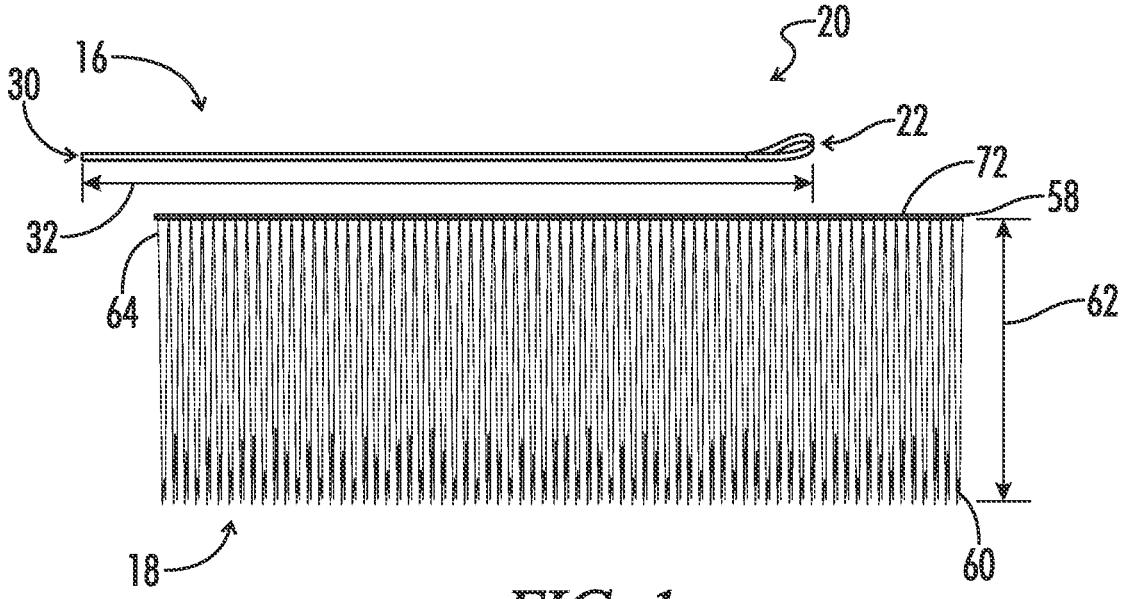
FIG. 1 illustrates a side elevation view of a hair extension of one embodiment of the present invention.

With reference to FIGS. 1-7, the present invention provides a hair extension 10 configured to secure to the natural hair 12 of a user 14. Preferably, the user's 14 natural hair 12 is fashioned into a ponytail hairstyle. In the drawings, not all reference numbers are included in each of the drawings for the sake of clarity. FIGS. 1-7 are drawn generally to scale. However, it will be appreciated that other dimensions are possible.

In some embodiments, the hair extension 10 may comprise a band 16 and a plurality of strands of hair 18. Optionally, the band 16 is elastic. The band 16 may further comprise a looped end 20 comprising a loop 22. Optionally, the loop 22 comprises a loop outer end 24, a loop opening 26 through which a human user's hair can extend, and a loop base 28 located on a side of the loop opening 26 opposite the loop outer end 24. The band 16 may also comprise a band free end 30 opposite the looped end 20, a length 32 extending from the looped end 20 to the free end 30, a top 34, a bottom 36, a height 38 extending from the top 34 to the bottom 36 and perpendicular to the length 32, a front side 40, a rear side (not shown), a thickness (not shown) extending from the front side 40 to the rear side and perpendicular to the length 32 and height 38, a free end segment 46 comprising the band free end 30 and having a free end segment length 48 extending parallel to the band length 32, a looped segment 50 comprising the looped end 20 and having a looped segment length 52 extending parallel to the band length 32, and/or an intermediate segment 54 located between the free end segment 46 and the looped segment 50 and having an intermediate segment length 56 extending parallel to the band length 32.

Optionally, the hair extension 10 comprises a plurality of strands of hair 18 extending downwardly from the band intermediate segment 54. Each strand of hair in the plurality of strands of hair 18 may comprise a strand top end 58 connected to the band 16, a free strand bottom end 60 located opposite the strand top end 58, and/or a strand length 62 extending from the strand top end 58 to the strand bottom end 60 and substantially parallel to the band height 38. Optionally, the plurality of strands of hair 18 are spaced evenly apart about the band intermediate segment 54 or are located in clusters that are spaced substantially evenly apart about the band intermediate segment length 54. In some cases, the plurality of strands of hair 18 may comprise over one hundred individual strands of hair. Preferably, the plurality of strands of hair 18 are not located on the free end segment 46 or looped segment 50 of the band 16. Without being bound to any particular theory, having the free end segment 46 and looped segment 50 be hair free helps prevent the hair extension 10 from detaching when secured to the nature hair 12 of a user 14.

Optionally, the band length 32 is greater than the band height 38 and band thickness (not shown); the intermediate segment length 56 is greater than the free end segment length 48 and the looped segment length 52; the plurality of strands of hair 18 have approximately the same length 62; and/or the band height 38 is greater than the band thickness.

Figure 2:
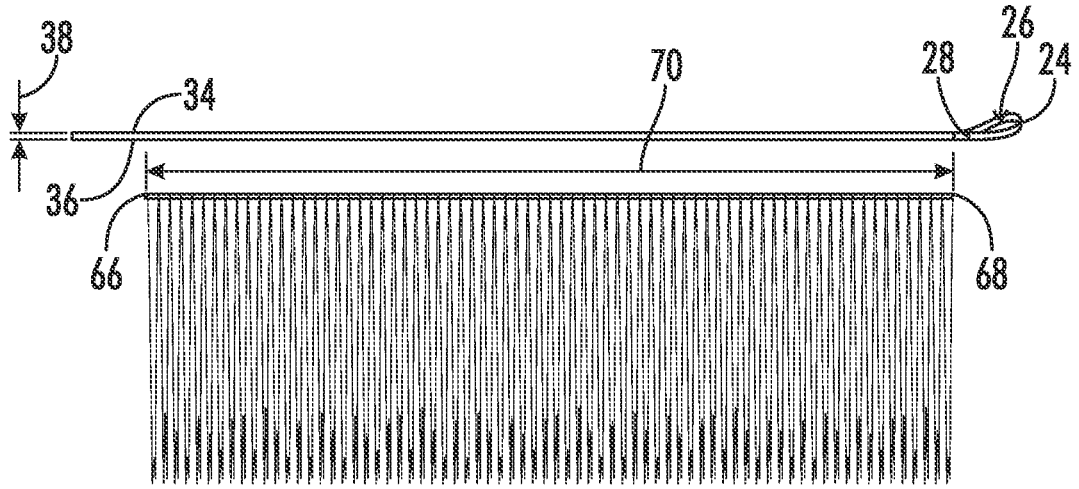
FIG. 2 illustrates another side elevation view of a hair extension of FIG. 1.
Figure 3:
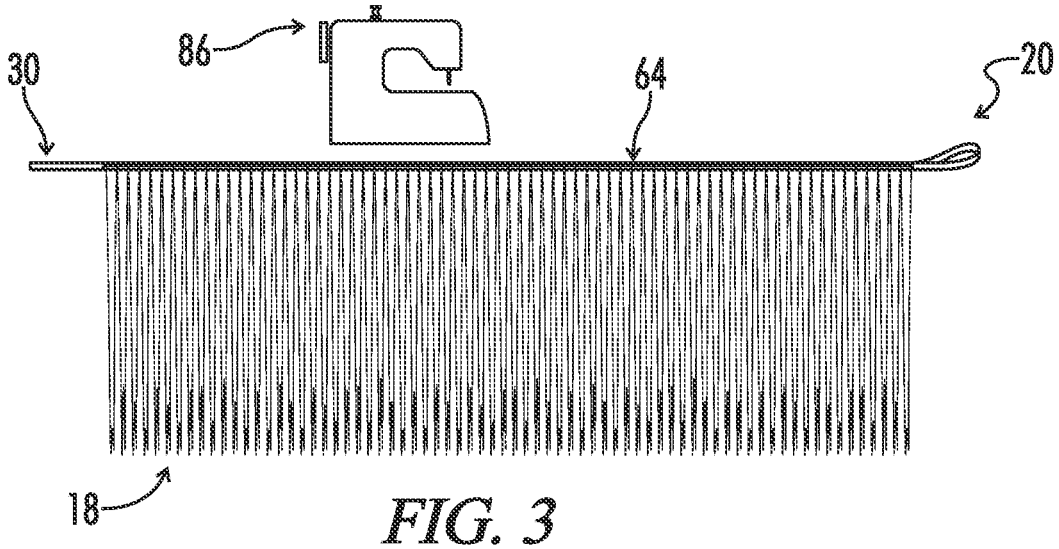
FIG. 3 illustrates another side elevation view of a hair extension of FIG. 1.

In some embodiments, the hair extension 10 further comprises a track 64 connecting the plurality of strands of hair 18 to the band intermediate segment 54, as shown between FIGS. 2 and 3. In the beauty industry, a track 64 may also be known as a weft. Optionally, the track 64 comprises a first end 66, a second end 68, a length 70 extending from the first end 66 to the second end 68 and parallel to the band length 32, a top 72, a bottom (not shown), a height (not shown) extending from the top 72 to the bottom and parallel the band height 38, a front side 78, a rear side (not shown), and/or a thickness (not shown) extending from the front side 78 to the rear side and parallel to the band thickness. In some cases, the track length 70 is substantially equal to the band intermediate segment length 56 and/or the track 64 is secured to the band 16 across the band intermediate segment 54. Preferably, the track 64 is not elastic. Optionally, the plurality of strands of hair 18 are sewn or woven into the track 64.

Figure 4:
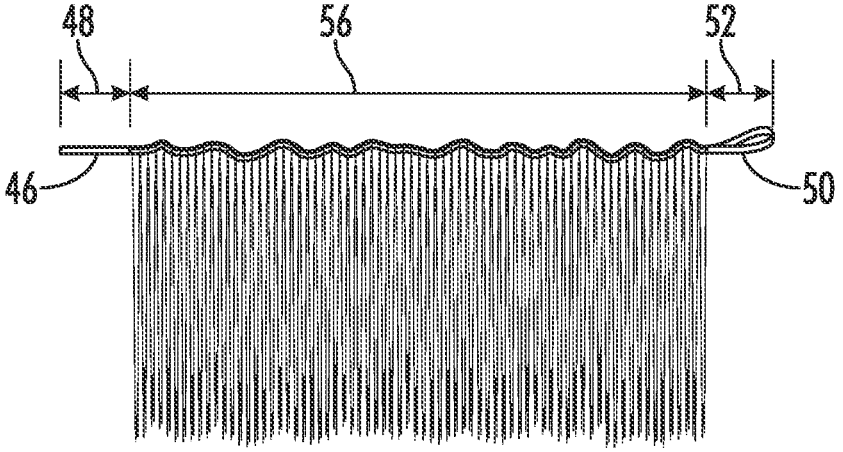
FIG. 4 illustrates another side elevation view of a hair extension of FIG. 1.
Figure 5:
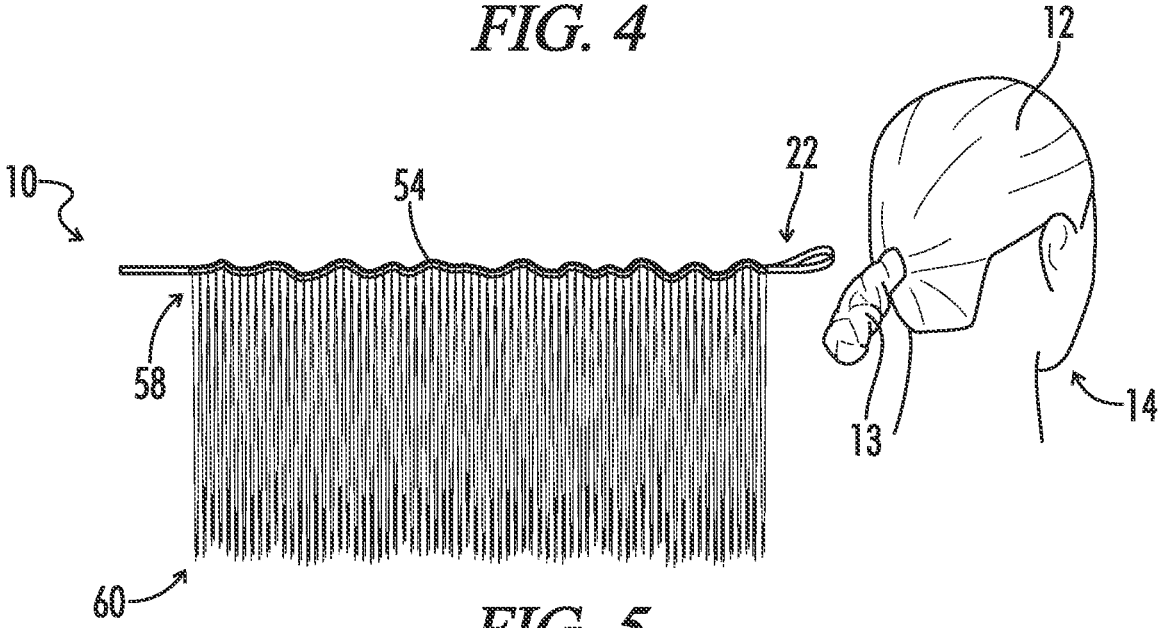
FIG. 5 illustrates another side elevation view of a hair extension of FIG. 1.
Figure 6:
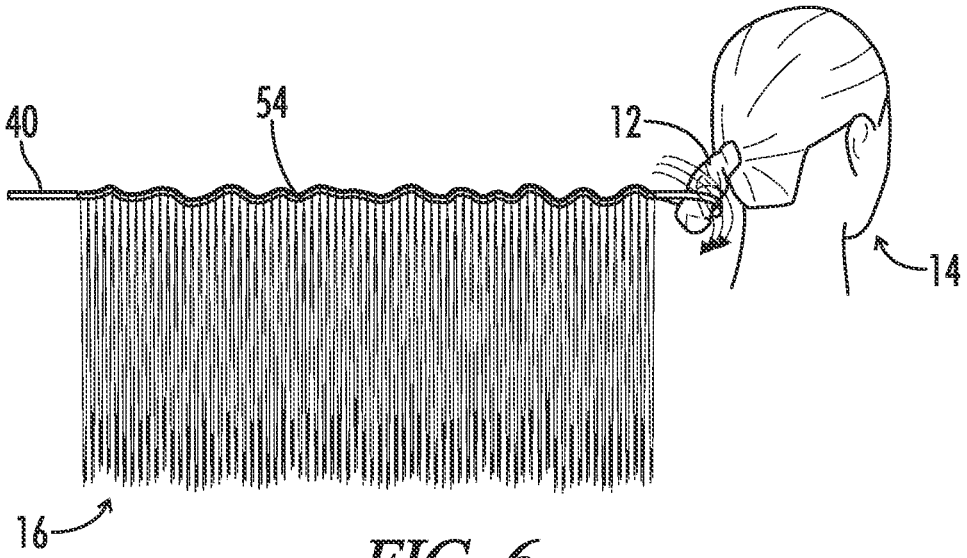
FIG. 6 illustrates another side elevation view of a hair extension of FIG. 1 in the process of being attached to a user's natural hair.

Optionally, the band 16 has a taut configuration, as shown in FIG. 3, and a relaxed configuration, as shown in FIG. 2. Preferably, the band length 32, free end segment length 48, intermediate segment length 56, and/or loop segment length 52 are shorter in the relaxed configuration than in the taut configuration. Preferably, a user may move the band 16 from the relaxed configuration to the taut configuration by pulling the band free end 30 and band looped end 20 further away from each other. In some cases, the track length 70 may be substantially equal to the intermediate segment length 56 in the taut configuration, as shown in FIG. 2. Optionally, the band intermediate segment 54 and track 64 have a wavy or curved shape when the band 16 is in the relaxed configuration, as shown in FIGS. 4-6. Optionally, the band intermediate segment 54 and track 64 are substantially straight when the band 16 is in the taut configuration, as shown in FIG. 3. Thus, the wavy pattern of the band intermediate segment 54 and track 64 may disappear when band 16 is stretched from the relaxed configuration to the taut configuration and may reappear when the band 16 is eased from the taut configuration to the relaxed configuration.

The curved or wavy pattern of the band intermediate segment 54 and the track 16 may be a result of stretching the band 16 when attaching the track 64 to the band 16, as shown in FIG. 3. The track 64 may be attached to the band 16 by sewing using a sewing machine 86, adding an adhesive, or any other suitable method of connecting textile materials. As shown in FIG. 4, the curvy or wavy pattern may appear when tension is released from the band 16 after the band 16 is sewn to the track 64 with a sewing machine 86. Because the band 16 may be elastic, and the track 64 may be inelastic, the two materials contract at different rates though they are sewn together. The curved or wavy pattern may appear as a result of the band 16 and track 64 trying to compensate for the difference in the contraction rates of the band 16 and track 64 materials. It is possible to make a hair extension 10 of the present invention without stretching the band 16 when the track 64 is being secured to the band 16. However, the benefits of the hair extension 10 of the present invention may be diminished if the band 16 is not stretched when the track 64 is being attached. Without being bound to any particular theory, stretching the band intermediate segment 54 when attaching the track to the band 16 allows the band intermediate segment 54 to stretch when the hair extension 10 is being secured to a user's 14 natural hair 12. This may help prevent the hair extension 10 from detaching from a user's natural hair 12 during use. If the band 16 is not stretched when the track 64 is attached to it, the band free end segment 46 and looped segment 50 may still stretch when the hair extension 10 is being secured to a user's 14 natural hair 12, but the hair extension 10 may be more likely to detach from a user's hair 12 during use.

Figure 7:
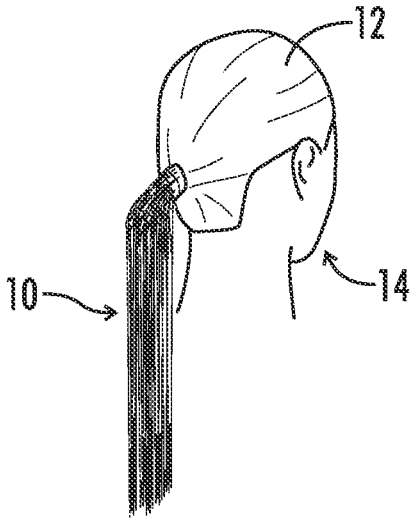
FIG. 7 illustrates a rear perspective view of a hair extension of FIG. 1 attached to a user's natural hair.

To attach the hair extension 10 to a user's hair 12, a user 14 may provide a hair extension 10 as described herein and removably secure the hair extension 10 to the user's hair 12. Preferably, the user 14 has a ponytail 13 and the hair extension 10 is secured to the ponytail 13. To removably secure the hair extension 10 to a user's hair 12, the user's hair 12 may first be inserted through the loop opening 26, as shown in FIG. 7. Optionally, the user 14 may twist the loop 22 to divide the loop opening 26 in to two smaller openings 26 forming the shape of an '8'. The user's hair 12 may then be inserted into the new opening 26. The steps of twisting the loop 22 to create smaller openings 26 and inserting the user's hair 12 through the openings 26 may be repeated as needed to secure the loop 22 of the hair extension 10 to the user's hair 12, especially if the user's hair is thin 12. This is similar to how a standard ponytail holder may be attached to a user's hair 12. Preferably, after the loop 22 of the hair extension 10 is secured to a user's hair 12, a user 14 will wrap the intermediate segment 54 and free end segment 46 of the hair extension 10 around a user's hair 12 near the scalp, as shown in FIG. 7. Optionally, the free end segment 46 may be secured around the user's hair 12 to prevent the hair extension 10 from unwrapping from the user's hair 12. Preferably, the free end segment 46 is tucked underneath a portion of the band 16 and/or between the band 16 and the user's 14 natural hair 12. It is possible but not necessary to use adhesives, bobby pins, clips, hook and loop, or other methods/devices to secure the free end 30 and prevent the hair extension 10 from unraveling. Preferably, the hair extension 10 is self-secured to a user's hair 12 without using adhesives, bobby pins, clips, hook and loop, or other methods/devices that may damage hair. Optionally, a user 14 may wrap a portion of the user's hair 12 or hair strands from the plurality of strands of hairs 18 around the base of the newly formed ponytail and over the band 16 and/or track 64 to conceal the band 16 and/or track 64. Without being bound to any particular theory, this helps give the appearance that the hair extension 10 is part of the user's natural hair 12.

Optionally, the plurality of strands of hair 18 may be made from artificial hairs and/or natural hairs. Preferably, the plurality of strands of hair 18 are colored. For example, the plurality of strands of hair 18 may be blonde, black, brown, red, grey, or any hair color that a user's hair 12 may be, natural or artificial. Optionally, the plurality of strands of hair 18 may be any combination of colors to give the appearance of highlight, lowlights, balayage, or any other desirable hair color pattern. Preferably, the plurality of strands of hair 18, band 16, and/or track 64 are the same color to give the appearance that the hair extension 10 is part of the user's natural hair 12. Optionally, the plurality of strands of hair 18 may be straight, curled, wavy, braided, or shaped into any other desirable pattern.

In some cases, the loop 22 may be formed by a tip 84 of the band 16 in the looped segment 50 that curves back towards the intermediate segment 54 and secures to the band 16 either in the band looped segment 50 and/or in the intermediate segment 54. In other words, the loop 22 and band 16 may be made from one continuous piece of material and/or elastic. The tip 84 may be secured to the band 16 by sewing, adding an adhesive, or any other suitable method of connecting textile materials.

Optionally, the band height 38 is approximately one half of an inch. The strand length 62 is optionally between about 10 inches and about 18 inches and is preferably about 14 inches. The band length 32 is optionally between about 18 inches and about 30 inches and is preferably about 24 inches. The loop opening 26 is optionally between about 1 inch and about 2 inches in diameter and is preferably about 1.5 inches in diameter. The free end segment length 48 is optionally between about 3 inches and about 5 inches and is preferably about 4 inches.

In another embodiment, the hair extension 10 may comprise a band 16 further comprising a looped end 20. The looped end 20 may further comprise a loop 22 having a loop outer end 24, a loop opening 26 through which a human user's hair 12 can extend, and a loop base 28 located on a side of the loop opening 26 opposite the loop outer end 24. Further, the hair extension 10 may comprise a band free end 30 opposite the looped end 20, a length 32 extending from the looped end 20 to the free end 30, a top 34, a bottom 36, a height 38 extending from the top 34 to the bottom 36 and perpendicular to the length 32, a front side 40, a rear side (shown), a thickness (not shown) extending from the front side 40 to the rear side and perpendicular to the length 32 and height 38, a free end segment 46 located adjacent the band free end 30 and having a free end segment length 48 extending parallel to the band length 32, a looped segment 50 adjacent the looped end 20 and having a looped segment length 52 extending parallel to the band length 32, and/or an intermediate segment 54 adjacent the free end segment 46 and the looped segment 50 and having an intermediate segment length 56 extending parallel to the band length 32.

Further, the hair extension 10 may comprise a plurality of strands of hairs 18 extending downwardly from the band intermediate segment 54, each strand having a strand top end 58, a free strand bottom end 60 located opposite the strand top end 58, and a strand length 62 extending from the strand top end 58 to the strand bottom end 60 and substantially parallel to the band height 38. Additionally, the hair extension 10 may comprise a track 64 connecting the plurality of strands of hair 18 to the band intermediate segment 54, the track comprising a first end 66, a second end 68, a length 70 extending from the first end 66 to the second end 68 and parallel to the band length 32, a top 72, a bottom (not shown), a height (not shown) extending from the top 72 to the bottom and parallel the band height 38, a front side 78, a rear side (not shown), and a thickness (not shown) extending from the front side 78 to the rear side and parallel to the band thickness.

Optionally, the track length 70 is substantially equal to the band intermediate segment length 56. Optionally, the track 64 is secured to the band 16 across the band intermediate segment 54. Optionally, the band length 32 is greater than the band height 38 and band thickness. Optionally, the intermediate segment length 56 is greater than the free end segment length 48 and the looped segment length 52.

Further, a tip 84 of the band 16 in the looped segment 50 may curve back towards the intermediate segment 54 and secures to the band 16 to form the loop 22. The tip 84 of the band 16 may secure on the same side and/or on the opposite side of the band 16 that the track 64 is connected to. For example, if the track 16 is connected to the front side 40 of the band 16, the tip 84 of the band 16 that curves back to the intermediate segment 54 to form the loop 22 may secure to the front side 40 and/or rear side of the band 16.

Throughout the specification and claims, the term "natural hair" is only used to differentiate the plurality of stands of hair 18 from the user's hair 12 that is present before the hair extension 10 is used and is not intended to be limiting. "Natural Hair" may refer to the hair that the user is able to grow, as well as hair from a wig or artificial hair integration.

| Part List | |
|---|---|
| Hair Extension | 10 |
| Natural Hair (User's Hair) | 12 |
| Ponytail | 13 |
| User | 14 |
| Band | 16 |
| Plurality of Strands of Hairs | 18 |
| Looped End | 20 |
| Loop | 22 |
| Loop Outer End | 24 |
| Loop Opening(s) | 26 |
| Loop Base | 28 |
| Band Free End | 30 |
| Band Length | 32 |
| Band Top | 34 |
| Band Bottom | 36 |
| Band Height | 38 |
| Band Front Side | 40 |
| Free End Segment | 46 |
| Free End Segment Length | 48 |
| Looped Segment | 50 |
| Looped Segment Length | 52 |
| Intermediate Segment | 54 |
| Intermediate Segment Length | 56 |
| Strand Top End | 58 |
| Strand Bottom End | 60 |
| Strand Length | 62 |
| Track | 64 |
| Track First End | 66 |
| Track Second End | 68 |
| Track Length | 70 |
| Track Top | 72 |
| Track Front Side | 78 |
| Band Tip | 84 |
| Sewing Machine | 86 |

Having now described the invention in accordance with the requirements of the patent statutes, those skilled in the art will understand how to make changes and modifications to the disclosed embodiments to meet their specific requirements or conditions. Changes and modifications may be made without departing from the scope and spirit of the invention. In addition, the steps of any method described herein may be performed in any suitable order and steps may be performed simultaneously if needed.

Terms of degree such as "generally", "substantially", "about" and "approximately" as used herein mean a reasonable amount of deviation of the modified term such that the end result is not significantly changed. For example, these terms can be construed as including a deviation of at least +5% of the modified term if this deviation would not negate the meaning of the word it modifies.

What is claimed is:

1. A method of attaching a ponytail extension to a ponytail of a user comprising the steps of:

A) providing a ponytail extension comprising:

i) an elastic band configured to attach to and wrap around a human user's ponytail, the elastic band comprising:

a) a looped proximal end comprising a loop, the loop comprising a loop outer end, a loop opening, and a loop base located on a side of the loop opening opposite the loop outer end, b) a free distal end opposite the looped proximal end, c) a length extending from the looped proximal end to the free distal end, d) a top, e) a bottom, f) a height extending from the top to the bottom and perpendicular to the length, g) a front side, h) a rear side, i) a thickness extending from the front side to the rear side and perpendicular to the length and height, j) an intermediate segment configured to wrap around the human user's ponytail and comprising an intermediate segment proximal end, an intermediate segment distal end and an intermediate segment length extending from the intermediate segment proximal end to the intermediate segment distal end, k) a free distal end segment configured to wrap around the human user's ponytail and comprising a free distal end segment proximal end extending distally from the intermediate segment distal end, a free distal end segment distal end comprising the free distal end and a free distal end segment length extending from the free distal end segment proximal end to the free distal end segment distal end, and l) A looped proximal segment comprising a looped proximal segment distal end extending proximally from the intermediate segment proximal end, and a looped proximal segment proximal end, the looped proximal segment comprising the looped proximal end and having a looped proximal segment length extending from the looped proximal segment proximal end to the looped proximal segment distal end, wherein the human user's ponytail is configured to be placed through the loop; and ii) a plurality of strands of hair extending downwardly from the intermediate segment, each strand having a strand top end, a free strand bottom end located opposite the strand top end, and a strand length extending from the strand top end to the strand bottom end and substantially parallel to the band height;

wherein the band length is greater than the band height and band thickness; and further wherein the intermediate segment length is greater than the free distal end segment length and the looped proximal segment length; and B) inserting the user's ponytail through the loop opening, and wrapping the intermediate segment and free distal end segment of the band around the user's ponytail to lengthen the ponytail with the plurality of strands.

2. The method of claim 1, wherein step B further comprises securing the free distal end to prevent the band from unwrapping, and wrapping a portion of the plurality of strands around a base of the ponytail to cover the band.

3. The method of claim 1, wherein the free distal end segment length is between about 3 inches and about 5 inches and the free distal segment does not include any hair.

4. The method of claim 1, wherein the band height is about 0.5 inches.

5. The method of claim 1, wherein the free distal end segment length is greater than the band height.

6. The method of claim 1, wherein the ponytail extension further comprises:

a track connecting the plurality of strands to the intermediate segment, the track comprising a track proximal end, a track distal end, a length extending from the track proximal end to the track distal end, a top, a bottom, a height extending from the top to the bottom and parallel the band height, a front side, a rear side, and a thickness extending from the front side to the rear side and parallel to the band thickness;

wherein the track length is parallel to and substantially equal to the intermediate segment length; and further wherein the track is sewn to the band across the-intermediate segment.

7. The method of claim 6, wherein the band has a taut configuration and a relaxed configuration, wherein the band length, free distal end segment length, intermediate segment length, and looped proximal segment length are shorter in the relaxed configuration than in the taut configuration, and further wherein a user may move the band from the relaxed configuration to the taut configuration by pulling the free distal end and looped proximal end further away from each other.

8. The method of claim 7, wherein the track is not elastic and contracts at a different rate than the intermediate segment.

9. The method of claim 8, wherein the track length is substantially equal to the intermediate segment length in the taut configuration;

the intermediate segment and track are substantially straight when the band is in the taut configuration; and the intermediate segment and track are wavy when the band is in the relaxed configuration.

10. The method of claim 1, wherein the band height is constant from the free distal end to the looped proximal end.

11. The method of claim 1, wherein each strand in the plurality of strands is comprised of artificial hair.

12. The method of claim 1, wherein each strand in the plurality of strands is comprised of natural hair.

13. The method of claim 1, wherein the looped proximal segment, intermediate segment, and distal free end segment are made from a single continuous piece of material.

14. The method of claim 1, wherein the plurality of strands are colored.

15. The method of claim 14, wherein the hair strands and the band are the same color.

16. The method of claim 1, wherein the plurality of strands are located in clusters that are spaced substantially evenly apart about the intermediate segment length.

17. The method of claim 1, wherein the ponytail extension comprises at least one hundred strands.

* * * * *